US005711275A

United States Patent [19]

Minagawa et al.

[11] Patent Number: 5,711,275

[45] Date of Patent: Jan. 27, 1998

[54] FUEL SUPPLY APPARATUS FOR AN INTERNAL COMBUSTION ENGINE

[75] Inventors: Kazuji Minagawa, Tokoname; Kiyotoshi Oi, Toyohashi; Katsumi Arai, Tatebayashi, all of Japan

[73] Assignees: Nippondenso Co., Ltd., Kariya; Kyosan Denki Co., Ltd., Tokyo, both of Japan

[21] Appl. No.: 700,868

[22] Filed: Aug. 21, 1996

Related U.S. Application Data

[63] Continuation-in-part of Ser. No. 694,065, Aug. 8, 1996.

[30] Foreign Application Priority Data

Sep. 1, 1995 [JP] Japan ..... 7-225241

[51] Int. Cl.[6] ..... F02M 41/00

[52] U.S. Cl. ..... 123/458; 123/511; 123/179.17

[58] Field of Search ..... 123/457, 463, 123/464, 497, 510, 511, 179.16–179.17; 137/597, 505.42

[56] References Cited

U.S. PATENT DOCUMENTS

| | | | |
|---|---|---|---|
| 4,653,528 | 3/1987 | Field et al. | 123/511 |
| 4,807,583 | 2/1989 | Thornwaite | 123/516 |
| 5,052,359 | 10/1991 | Hardwick et al. | 123/179.16 |
| 5,163,472 | 11/1992 | Takada | 137/507 |
| 5,181,494 | 1/1993 | Ausman et al. | 123/179.17 |
| 5,284,119 | 2/1994 | Smitley | 123/497 |
| 5,327,872 | 7/1994 | Morikawa | 123/179.17 |
| 5,361,742 | 11/1994 | Briggs et al. | 123/497 |
| 5,379,741 | 1/1995 | Matysiewicz et al. | 123/497 |
| 5,385,170 | 1/1995 | Tonhauser | 123/198 DB |
| 5,398,655 | 3/1995 | Tuckey | 123/497 |
| 5,413,077 | 5/1995 | Hornby et al. . | |
| 5,448,977 | 9/1995 | Smith et al. . | |
| 5,458,104 | 10/1995 | Tuckey | 123/463 |
| 5,509,390 | 4/1996 | Tuckey | 123/497 |
| 5,524,592 | 6/1996 | Woody | 123/510 |
| 5,542,395 | 8/1996 | Tuckey | 123/497 |
| 5,558,063 | 9/1996 | Minagawa et al. | 123/497 |
| 5,590,631 | 1/1997 | Tuckey | 123/447 |

FOREIGN PATENT DOCUMENTS 7-27029 7/1993 Japan .

OTHER PUBLICATIONS

USSN 08/694065 F. Aug. 1996 Appln. of Minagawa et al.

*Primary Examiner*—Thomas N. Moulis
*Attorney, Agent, or Firm*—Nixon & Vanderhye P.C.

[57] ABSTRACT

A fuel pump is driven by a variable, constant current, control circuit. A pressure control valve disposed between the fuel pump and a fuel rail includes a downstream pressure control valve and a bypass valve bypassing the downstream pressure control valve. The downstream pressure control valve sets the fuel pressure in the fuel rail to a predetermined value by opening or closing a passage from a fuel pipe to the fuel rail. If the fuel pump discharge pressure is sufficiently increased, the bypass valve is opened when the upstream fuel pressure is larger than the downstream fuel pressure by at least a predetermined differential pressure. In this way, fuel is supplied to raise the fuel rail fuel pressure. Therefore, it is possible during other times to reduce the consumed electric power of the fuel pump and thus prolong its life.

28 Claims, 10 Drawing Sheets

FUEL SUPPLY APPARATUS FOR AN INTERNAL COMBUSTION ENGINE

CROSS REFERENCE TO RELATED APPLICATIONS

The present invention is based upon and claims priority of Japanese patent Application No. Hei 7-225241 filed on Sep. 1, 1995, the content of which is incorporated herein by reference.

This application is a continuation-in-part of the earlier co-pending commonly assigned U.S. application Ser. No. 08/694,065 filed Aug. 8, 1996 entitled "Fuel Supply Apparatus for Engines" and naming Messrs. Minagawa and Oi as inventors.

BACKGROUND OF THE INVENTION

1. Field of the Invention

The present invention relates to a fuel supply apparatus for an internal combustion engine, more specifically to a fuel supply apparatus for an internal combustion engine, which supplies fuel to a fuel rail or the like by controlling electric current supplied to the motor for driving a fuel pump.

2. Description of Related Art

A conventional fuel supply apparatus, for injecting fuel into an intake port of an internal combustion engine, sucks the fuel by a fuel pump in a fuel tank and leads the fuel to a fuel rail through a fuel pipe, so that the fuel is injected and supplied toward the intake port from fuel injection valves fixed to the fuel rail so as to correspond to respective cylinders. To maintain the pressure of the fuel supplied to the fuel injection valve at a predetermined value, a pressure regulator is disposed in the fuel rail in addition to a return pipe returning excess fuel to the fuel tank.

In a fuel supply apparatus having the return pipe, the fuel rail is heated to a high temperature, so that a fuel temperature inside the fuel rail rises since the fuel rail is located in the vicinity of the internal combustion engine. Accordingly, a temperature of surplus fuel to be returned from the return pipe to the fuel tank becomes high, which raises a temperature of a fuel inside the fuel tank and generates a large amount of vapor. Furthermore, this system requires a return pipe, thereby causing high cost.

In light of the above problem, a fuel supply apparatus of an engine has been proposed in, for example, JP-A-7-27029 as a fuel supply apparatus without having a return pipe (return-less fuel supply apparatus) for returning surplus fuel in a fuel rail to a fuel tank.

In this system, the fuel pump is disposed inside the tank, and a pressure control valve (downstream pressure control valve) for closing a fuel supply passage between the fuel pump and the fuel rail is disposed when a pressure reaches a predetermined value. In addition, a pressure regulator is disposed, which operates at a slightly higher pressure than a pressure regulated by the downstream pressure control valve in the fuel pump body, and thereby surplus fuel circulates inside the fuel tank directly.

However, the downstream pressure control valve employed in such a return-less fuel supply apparatus is so designed as to set the fuel pressure in the fuel rail to a predetermined value by a diaphragm which operates according to the fuel pressure and springs each applying a spring force on the diaphragm and a valve member. In case the fuel pressure is set low by the downstream pressure control valve, vapor generates according to the increase of the temperature in the fuel rail. In short, when the flow of fuel stops in a state of the internal combustion engine at a high temperature such as when the engine restarts at a high temperature, vapor generates in the fuel due to high fuel temperature (for example, approximately 80° C.) in the fuel rail if the fuel pressure is set low. Once vapor generates, it causes a problem that the engine may not be able to start because the fuel is not injected properly.

Therefore, the fuel pressure is normally set high by increasing a spring force applied on the diaphragm of the downstream pressure control valve to prevent vapor from being generated. However, in this case, another problem has occurred due to a higher fuel pressure.

That is, there have been problems such as consumed electric power of the fuel pump is increased and the fuel pump has to be operated harder to set the fuel pressure high, which shortens the life of the fuel pump or the like.

SUMMARY OF THE INVENTION

In light of the above-described problems, an object of the present invention is to provide a fuel supply apparatus for an internal combustion engine which can reduce the consumed electric power of the fuel pump.

Another object of the present invention is to provide a fuel supply apparatus for an internal combustion engine which can prolong the life of the fuel pump or the like.

In the fuel supply apparatus according to the present invention, a fuel pump pressurizes and discharges fuel to a fuel rail through a fuel supply passage, the fuel in the fuel rail is supplied to a fuel injector and is injected into an internal combustion engine. A pressure control valve is disposed between the fuel pump and the fuel rail to maintain the fuel pressure on a downstream side thereof at a predetermined value by opening or closing the fuel supply passage according to the fuel pressure in the fuel rail. A bypass valve is disposed in a bypass passage for connecting an upstream side to said downstream side of the pressure control valve so as to bypass the pressure control valve, and the bypass valve opens or closes the bypass passage.

According to the above constitution, the fuel pump pressurizes and delivers fuel to the fuel supply passage. The fuel, supplied into the fuel rail from the fuel supply passage, is injected by a fuel injection valve. The pressure control valve maintains the fuel pressure in the fuel rail at a predetermined value, however, by opening or closing the bypass valve disposed in the bypass passage bypassing the pressure control valve, the fuel pressure set by the pressure control valve is further adjusted.

That is, if only the pressure control valve is used, the fuel pressure can be simply set to a predetermined value in advance, however, practically the fuel pressure should be minutely adjusted in accordance with an operating condition. Therefore, in the present invention, the fuel pressure can be preferably set as needed by adjusting the opening or closing the bypass valve.

Further, the bypass valve may be used to release a pressure on the upstream side to the downstream side. In this way, when the pressure on the upstream side becomes high, the bypass valve opens the fuel supply passage to supply the high pressure to the fuel rail on the downstream side, thereby increasing the fuel pressure appropriately.

Furthermore, a relief valve may be employed as a bypass valve which is opened when the pressure on the upstream side is higher than the pressure on the downstream side with a predetermined differential pressure.

For example, in case a discharge pressure of the fuel pump is P1, the fuel pressure in the fuel rail is P2, and a differential pressure for opening the relief valve is ΔP, those relationships are expressed by the following equations (1) and (2).

$$P2=P1-\Delta P \quad (1)$$

$$P1=P2+\Delta P \quad (2)$$

These relations are illustrated in FIG. 2. The fuel pressure (normal time: F/R fuel pressure P2) in the fuel rail is normally constant whereas a discharge pressure (normal time: F/P discharge pressure P1) of the fuel pump is set higher than the F/R fuel pressure P2. In case of need, a discharge pressure (necessary F/P discharge pressure P1') of the fuel pump is raised, however, since an opening pressure (differential pressure) of the relief valve is ΔP, the fuel pressure (necessary F/R fuel pressure P2') in the fuel rail is set low by the differential pressure ΔP. That is, the fuel pressure in the fuel rail is always set properly corresponding to a discharge pressure of the fuel pump, because the differential pressure ΔP of the relief valve is set as described above.

In FIG. 2, the graph declines downwardly in the right direction in accordance with the increase of a fuel supply amount due to a fluid loss of the fuel pump.

Still further, the opening pressure of the bypass valve may be set a value so as not to be opened when the fuel pump discharges fuel with normal pressure. That is, as shown in FIG. 2, the opening pressure of the relief valve is set to a value so that the necessary F/R fuel pressure P2' exceeds the normal F/P fuel pressure P1. It means that the relief valve is opened only in case of need so as to increase a pressure in the fuel rail higher than a normal value, and in the other cases, it prevents the relief valve from being opened. Thus, the fuel is not normally supplied to the fuel rail after passing through the relief valve but when a discharge pressure of the fuel pump increases in case of need, the relief valve is opened so as to increase the fuel pressure in the fuel rail.

Further, in case the pressure on the Upstream side becomes larger than the pressure on the downstream side, the bypass valve may be opened. In such a case, pressure is accurately controlled, because the timing to open the bypass valve can be properly selected. An electromagnetic valve may be employed as the bypass valve.

Furthermore, an operating condition (i.e., discharge pressure of the fuel) of the fuel pump may be adjusted by controlling a current value of the direct current electric motor in accordance with an operating condition of the internal combustion engine. In this way, the fuel pressure in the fuel rail can be adjusted through the bypass valve according to various operating conditions appropriately, thereby adjusting fuel pressure easily and accurately.

When the operating condition of the internal combustion engine satisfies a predetermined condition to increase a fuel pressure in said fuel rail, a current value of the direct current electric motor may be increased.

That is, in case of the predetermined operating condition, a current value of the motor for driving the fuel pump is increased so as to raise a discharge pressure of the pump, and therefore, it is possible to supply higher pressure fuel to the fuel rail through the bypass valve and to increase the fuel pressure in the fuel rail.

Still further, when the engine restarts with its fuel temperature higher than a predetermined temperature, the current value may be increased.

That is, when the engine restarts at a high temperature, the fuel temperature becomes higher than that in the normal operation (because of excess heat from the engine and remaining fuel), and vapor may be generated. However, according to the present invention, vapor can be suppressed from being generated since the current value of the fuel pump is increased to raise the fuel pressure when the engine restarts at a high temperature, and therefore, it is possible to maintain startability properly. In the present invention, the fuel pressure is increased only in case of need such as the engine has to restart at a high temperature or the like. In the other cases, the fuel pressure (i.e., a set pressure by the pressure control valve) can be set low. Therefore, it is possible to effectively reduce the consumed electric power of the fuel pump and to prolong the life of the fuel pump or the like, because the normal fuel pressure is low.

Still further, when the engine starts with its fuel temperature lower than a predetermined temperature, the current value may be increased. However, this predetermined temperature is lower than that when the engine restarts in a state the fuel temperature is high as described above.

That is, when the engine starts at a low temperature, since the engine is cool and its combustion condition is not desirable, the emission deteriorates. However, in the present invention, a current value of the fuel pump is raised to increase the fuel pressure in starting the low temperature engine, a particle diameter of the atomized fuel in the fuel injection becomes small. In this way, the combustion condition is improved so that the discharge amount of HC is especially reduced and contributes to purification of the exhaust gas.

Further, the fuel pressure may be raised to change the combustion condition, when the fuel injection is increased such as when the turbocharger is operating.

For example, when the turbocharger is operating, the amount of fuel injection is normally increased, however, even if the pulse rage of the injection valve is the same, the amount of fuel injection can be properly increased in accordance with the operation of the turbocharger.

Other objects and features of the invention will be appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompany drawings in which:

FIG. 5A is a cross-sectional view taken along the line VA—VA in FIG. 5B, and FIG. 5B is a cross sectional view showing main features of a valve body or the like;

FIG. 8A is a top view of a valve body and a bypass valve, FIG. 8B is a perspective view showing the upper part of an interior guide, and FIG. 8C is a cross-sectional view of main features of a valve body or the like;

DETAILED DESCRIPTION OF THE PRESENTLY PREFERRED EMBODIMENTS

A first embodiment of a fuel supply apparatus for an internal combustion engine according to the present invention will be described with reference to the accompanying drawings.

Figure 3:
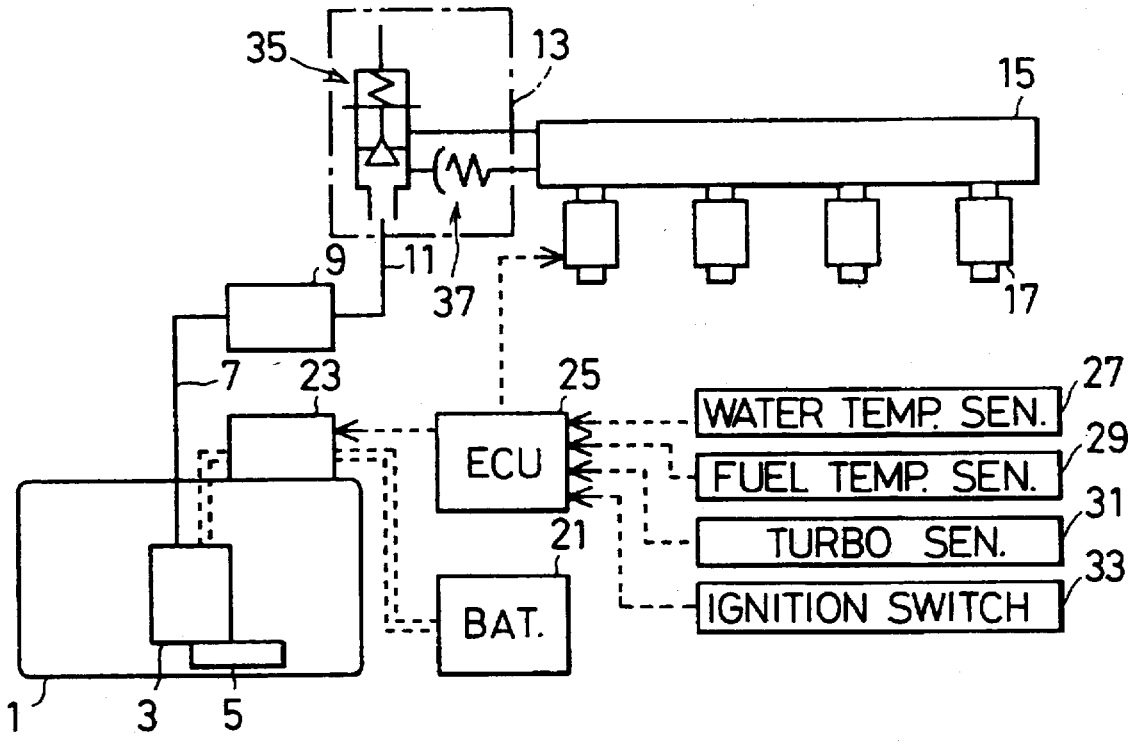
FIG. 3 is a view of a system construction in which a first embodiment is applied to an internal combustion engine.

FIG. 3 shows a fuel supply apparatus for an internal combustion engine (hereinafter simply called a fuel supply apparatus.

As shown in FIG. 3, the fuel supply apparatus includes a fuel pump 3 disposed inside a fuel tank 1, a low pressure fuel filter 5 connected to an inlet side of the fuel pump 3, a high pressure fuel filter 9 connected to a discharging side of the fuel pump 3 through a fuel pipe 7, a pressure control valve 13 connected to an outlet side of the high pressure fuel filter 9 through a fuel pipe 11, a fuel rail 15 disposed on a downstream side of the pressure control valve 13, fuel injectors 17, the number of which is equal to that of cylinders of the vehicle, for injecting and supplying fuel to an air intake port of the internal combustion engine (not shown) mounted on a vehicle, a constant current type control circuit 23 for controlling electric power supplied to the fuel pump 3 from a battery 21 by current control, an electric control unit (ECU) 25 for controlling the fuel injectors 17 and the constant current control circuit 23 or the like.

The ECU 25 includes a ROM, a RAM, a back-up RAM, a CPU, an input/output portion and a bus line for connecting these components with each other (which are not illustrated). The input/output portion is connected to, for example, a water temperature sensor 27 for detecting cooling water temperature, a fuel temperature sensor 29 for detecting a fuel temperature, a turbo-sensor 31 for detecting an operation status of a turbocharger or the like to input these signals. A signal from an ignition switch 33 indicative of the status of the ignition is input to the input portion to detect the starting operation. In addition, the input/output portion is connected to the constant current control circuit 23 and the fuel injectors 17, and outputs control signals thereto.

Since this fuel supply apparatus is a return-less fuel supply apparatus, a return pipe for returning fuel from the fuel rail 15 or the like to the fuel tank 1 is not necessary. Therefore, in this embodiment, current supplied to a pump motor (a direct current electric motor) of the fuel pump 3 is normally controlled by the constant current control circuit 23 in order to keep the fuel pressure in the fuel rail 15 constant with respect to a fuel injection amount from the fuel rail 15.

A structure of the pressure control valve 13, which is one of main features of this embodiment in the above system will be described.

The pressure control valve 13 is roughly composed of a downstream pressure control valve 35 disposed between the fuel pipe and the fuel rail 15 and a bypass valve 37 disposed in a passage bypassing the downstream pressure control valve 35, and the bypass valve 37 is incorporated into the downstream pressure control valve 35.

The downstream pressure control valve 35, which operates according to a negative pressure introduced from an intake manifold (not shown), a spring pressure, and the fuel pressure, sets the fuel pressure (downstream pressure) inside the fuel rail 15 to a predetermined value by opening or closing the passage leading from the fuel pipe 11 to the fuel rail 15 as described below. In this embodiment, the fuel pressure is set to be lower than a conventional value to prevent the vapor from being generated when the fuel temperature is high, as described below.

On the other hand, the bypass valve 37 is a relief valve which is opened (the characteristics of which is illustrated FIG. 2) when the fuel pressure of the fuel pipe 11 on the upstream side is higher than a pressure of the fuel rail 15 on the downstream side by a predetermined differential pressure $\Delta P$. When the bypass valve 37 is opened, the fuel is supplied from the upstream side to the downstream side and raises the fuel pressure inside the fuel rail 15.

A structure of the downstream pressure control valve 35 and the bypass valve 37 as well as the entire structure of the pressure control valve 13 will be described in detail.

Figure 4:
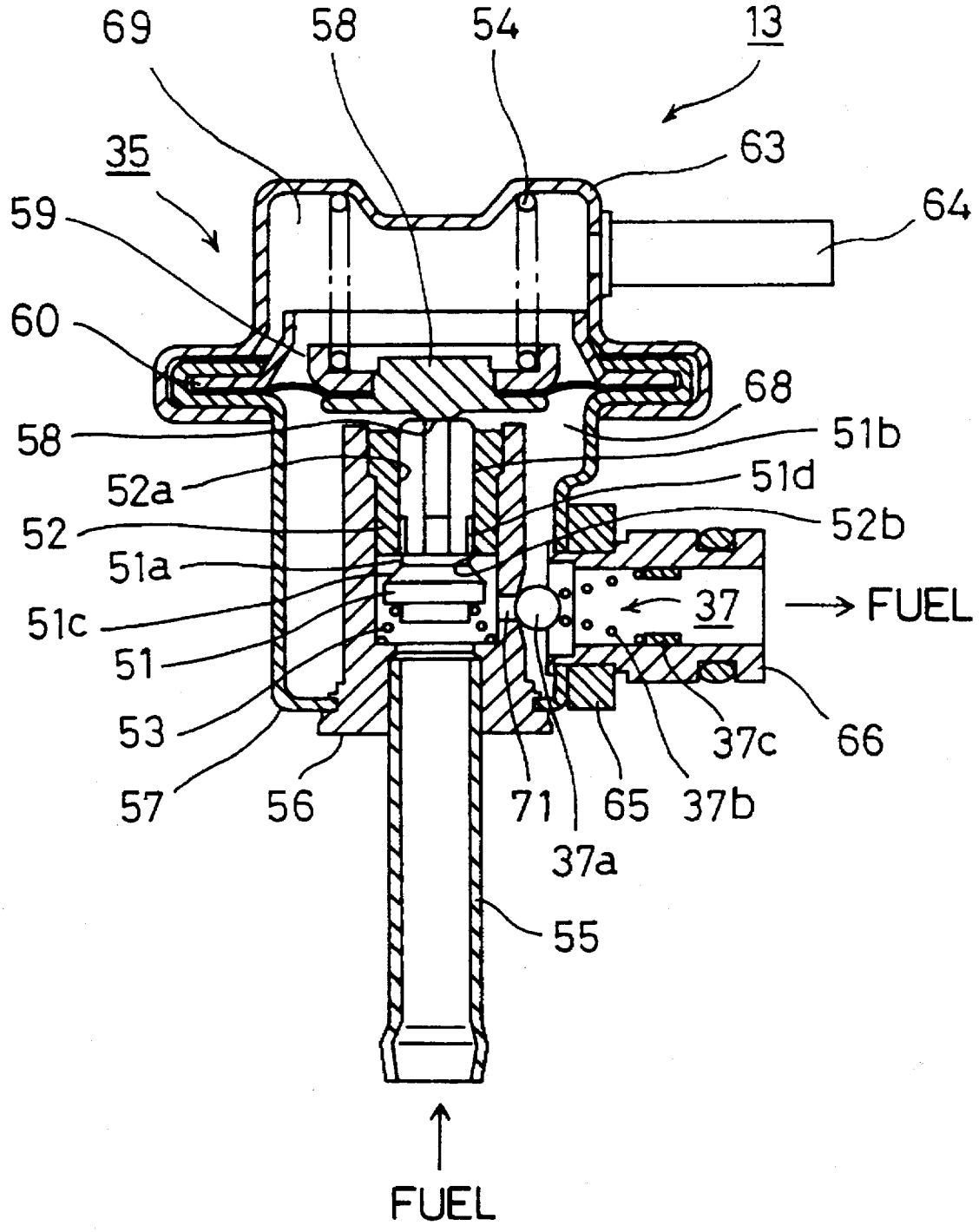
FIG. 4 is a cross sectional view of a pressure control valve according to the first embodiment.

In the pressure control valve 13 as shown in FIG. 4, a diaphragm 60 is fixedly seamed in the boundary between a body 57 and a cover 63. The center of the diaphragm 60 is sandwiched by a valve presser 58 and a lower seat 59. The diaphragm 60, the valve presser 58, and the lower seat 59 reciprocate integrally. The lower seat 59 is biased toward a diaphragm lower chamber 68 (in the valve opening direction, i.e., downward in the figure) as a second pressure chamber described below by a compression coil spring 54 located between the inner wall of the cover 63 and the lower seat 59.

A diaphragm upper chamber 69 as a first pressure chamber accommodating the compression coil spring 54 is connected to an intake manifold with a pipe 64. An interior pressure in the diaphragm upper chamber 69 is set to a negative pressure in the intake manifold.

On the other hand, the body 57 is connected to a pipe 55, which is connected to the fuel pipe 11, with a cylindrical connector 56. A connector 66, which can be installed to the fuel rail 15, is installed by a flange 65. The diaphragm lower chamber 68 formed in the body 57 accommodates the connector 56 having a pipe 55 at one end. A cylindrical valve body 52 having a valve seat 52*b* and a valve member 51 having an interior guide 51*b* slidable in the valve body 52 are accommodated in the connector 56. The valve member 51 is biased in the valve closing direction (upwardly in the figure) by the compression coil spring 53 accommodated in the connector 56.

Figure 5A:
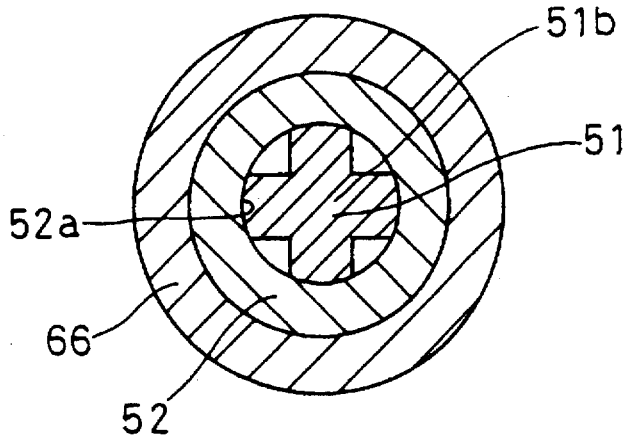
FIGS. 5A and 5B show main features of a control valve in the first embodiment.
Figure 5B:
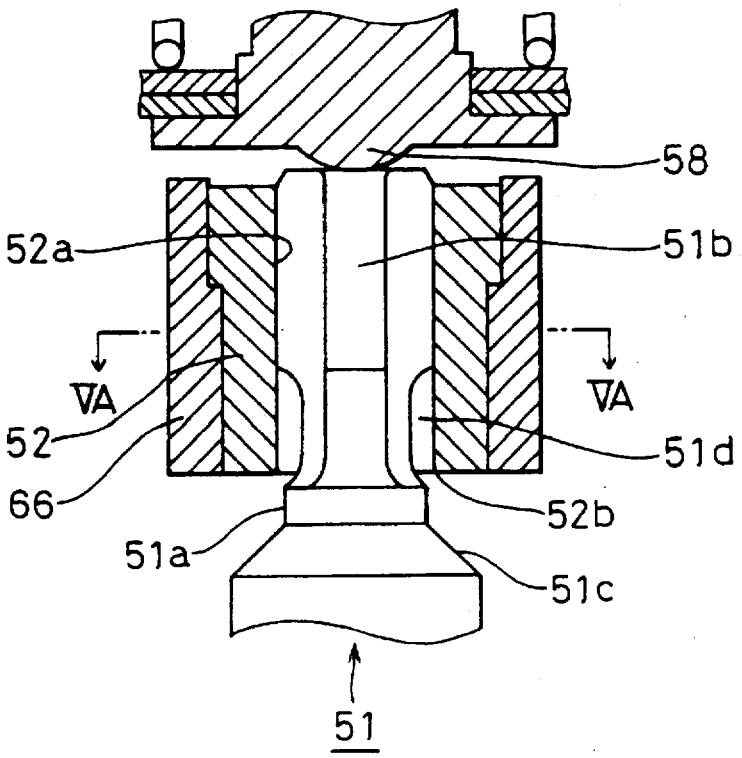

The valve body 51 has a contacting portion 51*c* (in contact with the valve seat 52*b*) which is tapered off toward the interior guide 51*b* as shown in FIG. 5B, and further has a cylindrical spool 51*a* between the contacting portion 51*c* and the interior guide 51*b*. An outer diameter of the spool 51*a* is slightly smaller than an inner diameter of the valve body 52. A radial cross section of the interior guide 51*b* is formed in a cross shape, and a recess portion 51*d* is formed in the vicinity of the contacting portion with the spool.

The downstream pressure control valve 35 is mainly constituted as the above, however, especially in this embodiment, the bypass valve 37 bypassing the downstream pressure control valve 35 is provided.

That is, a communicating passage (a bypass passage 71) is formed on the wall surface of the connector 56 so as to communicate the pipe 55 on the upstream side with the connector 66 on the downstream side. The bypass valve 37 is disposed to control i.e., to open or close the bypass passage 71 from the side of the connector 66 (i.e., the side of the fuel rail 15).

The bypass valve 37 is composed of a valve member 37*a* contacting with the bypass passage 71, a compression coil spring 37*b* biasing the valve member 37*a* in the valve closing direction (left direction in the figure), and an engaging member 37*c* for engaging the compression coil spring 37*b*.

An operation of the system will be described with the operation of the pressure control valve 13 based on FIGS. 3–5.

As a basic operation in the system as shown in FIG. 3, when fuel is sucked by the fuel pump 3 disposed in the fuel tank 1, extraneous materials or the like are removed by the low pressure fuel filter 5. The fuel sucked by the fuel pump 3 is delivered to the high pressure fuel filter 9 through the fuel pipe 7. Then, the high pressure fuel filter 9 removes minute extraneous materials, water or the like contained in the fuel, and the filtered fuel passes through the fuel pipe 11 to be delivered to the fuel rail 15 through the pressure control valve 13. The high pressure fuel supplied to the fuel rail 15 is injected to the intake inlet port of the internal combustion engine from the fuel injectors 17.

In the pressure control valve 13 as shown in FIG. 4, when the differential pressure between the diaphragm upper chamber 69 and the diaphragm lower chamber 68 exceeds a predetermined value, the contacting portion 51*c* of the valve member 51 is seated on the valve seat 52*b* of the valve body 52 (by moving upwardly in the figure) so that the pressure control valve 13 is closed. Then, when the fuel pressure decreases to a target fuel pressure value by fuel injection or the like, the contacting portion 51*c* of the valve member 51 is lifted from the valve seat 52*b* of the valve body 52 so that the pressure control valve 13 is opened. In this way, the fuel pressure in the fuel rail 15 located on the downstream side of the pressure control valve 13 is controlled to be a constant value.

The valve presser 58 is displaced according to the balance of the pressure (i.e., intake manifold pressure) in the diaphragm upper chamber 69, the fuel pressure introduced into the diaphragm lower chamber 68 (i.e., fuel pressure in the fuel rail 15), the spring force in the valve opening direction of the compression coil spring 54 in the diaphragm 69, and the spring force in the valve closing direction of the compression coil spring 53. By this displacement, the valve member 51 contacting with the valve pressure 58 moves in the valve opening or the valve closing direction.

More specifically, high pressure fuel in the diaphragm lower chamber 68 is discharged through the fuel rail 15 by fuel injection or the like, so that the fuel pressure in the diaphragm lower chamber 68 decreases. When the sum of the interior pressure of the diaphragm upper chamber 69 and the spring force of the compression coil spring 4 becomes larger than the sum of the fuel pressure in the diaphragm lower chamber 68 and the spring force of the compression coil spring 53, the valve presser 58 is displaced in the valve opening direction (downwardly in the figure), and the valve member 51 is pressed by the valve presser 58 so as to be opened. When the valve member 51 is opened, since the fuel pressure in the diaphragm lower chamber 68 gradually rises, the sum of the fuel pressure in the diaphragm lower chamber 68 and the spring force in the valve closing direction of the compression coil spring 53 becomes larger than the sum of the interior pressure of the diaphragm upper chamber 69 and the spring force in the valve-opening direction of the compression coil spring 54. As a result, the valve presser 58 is displaced in the valve closing direction (upwardly in the figure) to close the valve member 51.

Accordingly, when the fuel supplied from the fuel pipe 11 to the pressure control valve 13 in the above-described operation flows into the connector 56 through the pipe 55 and the pressure becomes in a state as to open the pressure control valve 13, the contacting portion 51*c* of the valve member 51 is lifted from the valve seat 52*b* of the valve body 52 to open the pressure control valve 13, so that the fuel flows into the recess portion 51*d* of the valve member 51 after passing through a passage formed between the contacting portion 51*c* and the valve seat 52*b* . The fuel flowing into the recess portion 51*d* passes between the interior guide 51*b* of the valve member 51 and an inner peripheral surface 52*a* of the valve member 52, flows into the diaphragm lower chamber 68, and is supplied to the fuel rail 15 through the connector 66.

When the pressure in the fuel rail 15 increases by the supplied fuel and the pressure becomes in a state as to close the pressure control valve 13, the contacting portion 51*c* of the valve member 51 is seated on the valve seat 52*b* of the valve body 52 so as to close the pressure control valve 13.

Thus, in case the fuel is normally injected by opening or closing the pressure control valve 13, the fuel pressure in the fuel rail 15 is maintained at a predetermined value.

When the internal combustion engine once stops and restarts (in restarting at high temperature) in such a normal operation, vapor may generate naturally because of high fuel temperature due to termination of the fuel injection.

Figure 6:
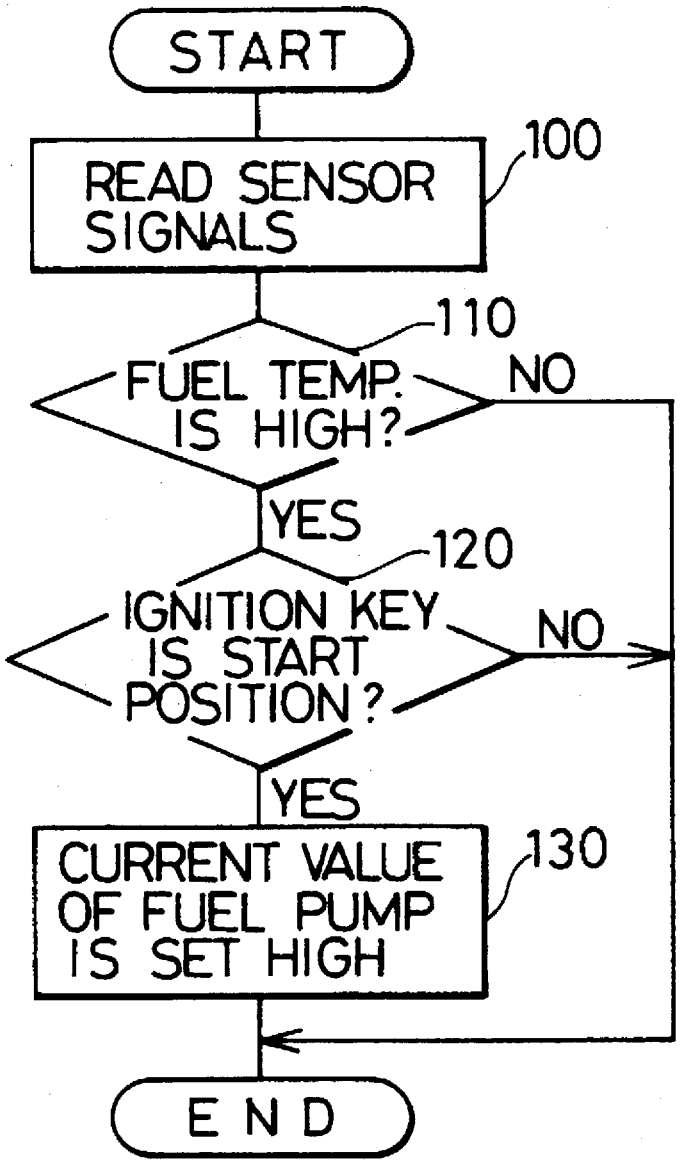
FIG. 6 is a flow chart showing a control process of the first embodiment.

In light of the above-described problem, to increase the discharge pressure of the fuel pump 3 in restarting the high temperature engine and to raise the fuel pressure in the fuel rail 15, a control process in the flow chart shown in FIG. 6 is performed.

At the step 100 in FIG. 6, firstly, signals from the water temperature sensor 27 and the fuel temperature sensor 29 are read in.

At the next step 110, it is determined whether or not the fuel temperature is higher than a predetermined value based on the signals. When the determination is YES, it proceeds to the step 120, however, in case the determination is NO, the process is ended once.

At the step 120, it is determined whether or not the ignition key is at the start position based on the signal from the ignition switch 33. When the determination is YES, it proceeds to the step 130, whereas the determination is NO, the process is ended once.

At the step 130, since it is determined that the engine restarts at a high temperature, a control signal is output to the constant current control circuit 23 so as to change a current value of the direct current electric motor of the fuel pump 3 to a higher value, and the process is ended once. The higher current value is returned to a normal current value after elapsing a predetermined time again.

Figure 1:
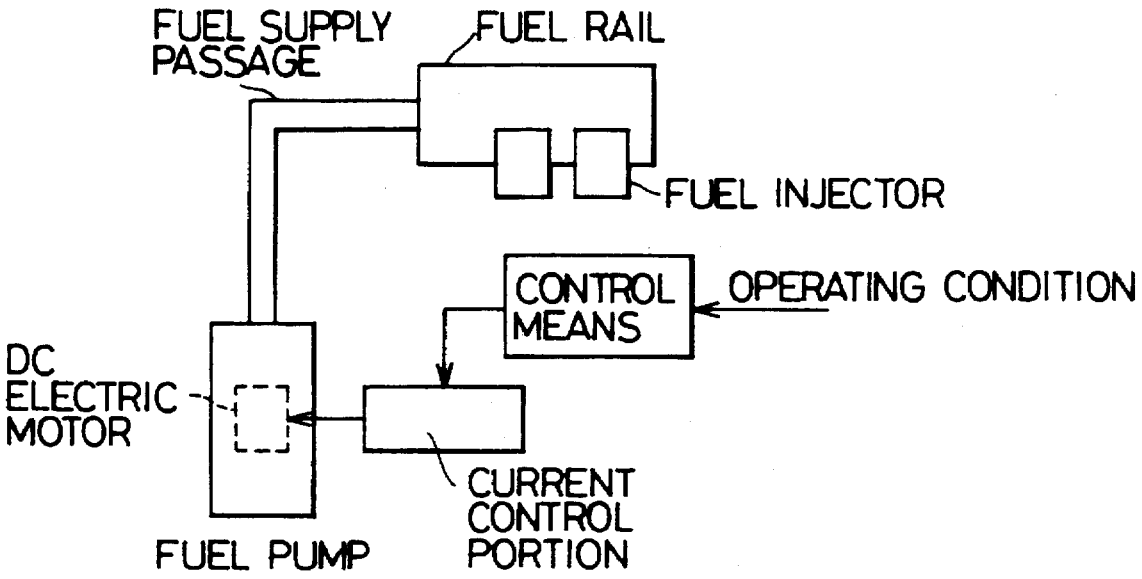
FIG. 1 is a general construction view of the present invention.
Figure 2:
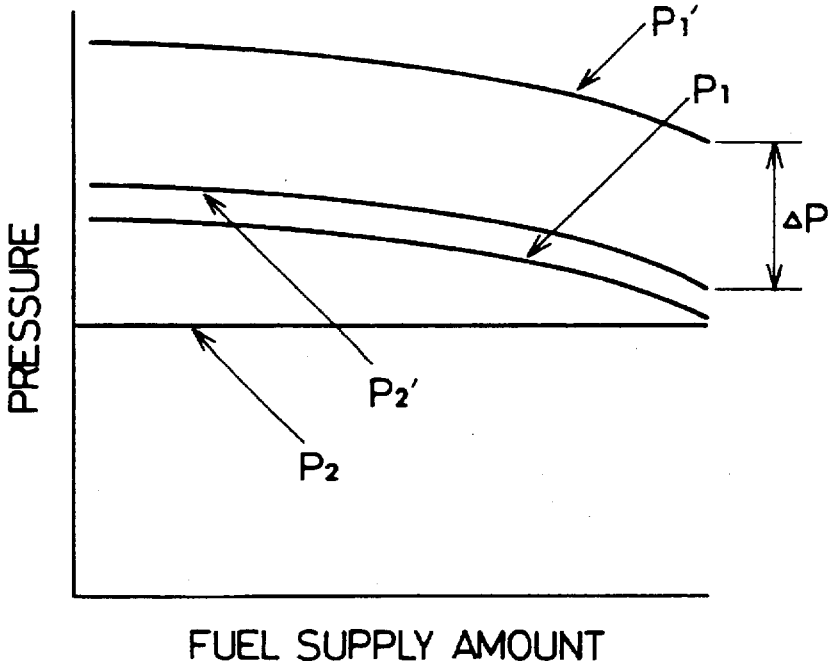
FIG. 2 is a graph showing a relationship between a discharge pressure of a fuel pump and a fuel pressure in a fuel rail.
Figure 7:
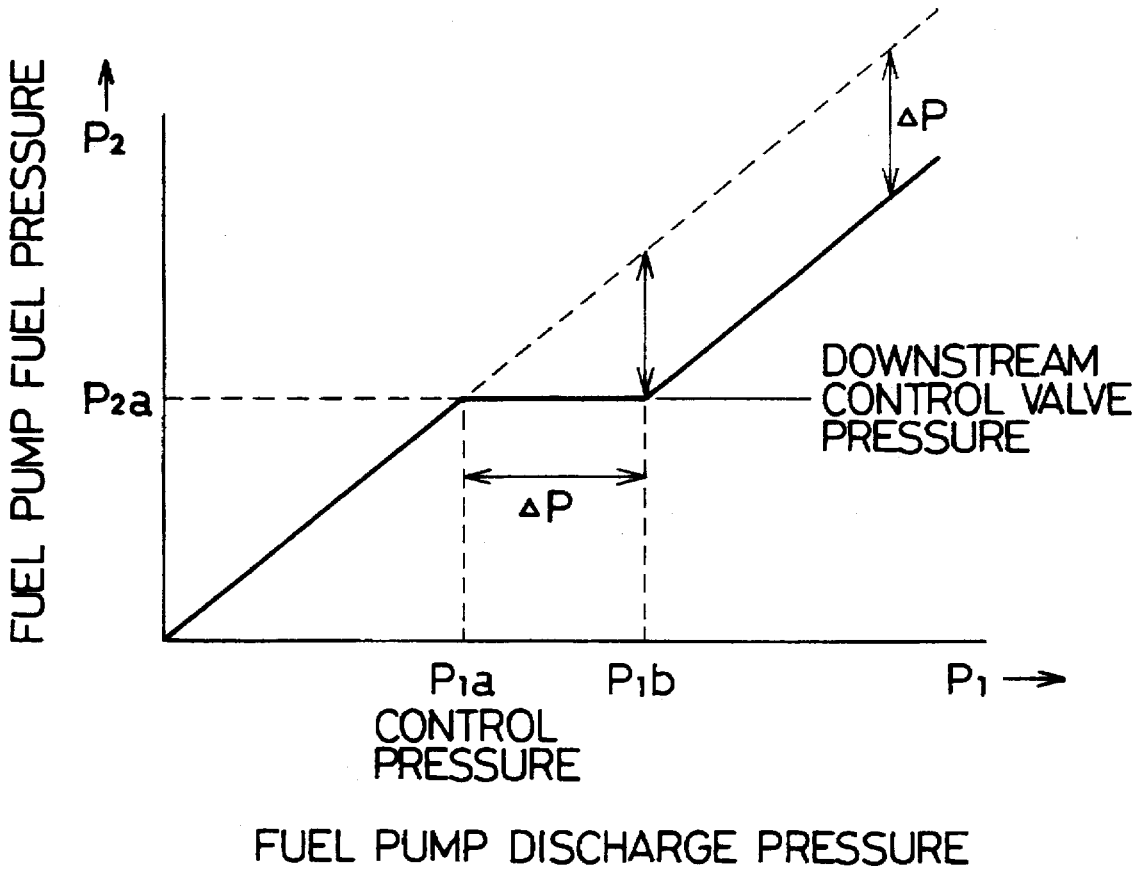
FIG. 7 shows a variation in the fuel pressure in the first embodiment.

The condition of the variation in the pressure due to the control process is shown in FIG. 7 where the fuel pressure (F/R fuel pressure) P2 in the fuel rail 15 gradually increases according to the increase of the discharge pressure (F/P discharge pressure) P1 of the fuel pump 3. When the F/P discharge pressure P1 reaches a set pressure P2*a* of the downstream pressure control valve 35, the pressure is controlled at the fixed set pressure P2*a* by the downstream pressure control valve 35 regardless of increase of the F/P discharge pressure P1. The fuel pump 3 normally operates at a constant current value as shown in FIG. 2, the F/P discharge pressure P1 of which is slightly higher than the F/R fuel pressure P2.

When the conditions of the steps 110 and 120 are satisfied, a current value of the fuel pump 3 increases. As a result, when the F/P discharge pressure P1 reaches P1*b* which is obtained by adding a predetermined pressure (control pressure) P1*a* to the differential pressure ΔP, the bypass valve 37 is opened to increase the F/R fuel pressure P2.

Although the discharge pressure of the fuel pump 3 increases in restarting the high temperature engine according to the control process, the downstream pressure control valve 35 is not opened since the fuel pressure inside the fuel rail 15 is a predetermined value (set pressure P2*a* of the downstream pressure control valve). However, in this embodiment, the downstream pressure control valve 35 is opened, because a bypass valve 37 is provided as a relief valve, which is opened when the discharge pressure of the fuel pump 3 gradually increases and reaches the predetermined differential pressure ΔP (between the upstream side and the downstream side), as shown in FIG. 7. In this way, fuel having high pressure is delivered to the downstream side through the bypass valve 37, so that the fuel pressure in the fuel rail 15 exceeds the normal set value. As a result, when fuel temperature is very high in a case such as in restarting the high temperature engine, the fuel pressure consequently increases. Therefore, since vapor is prevented from being generated, it is possible to improve the startability in restarting the high temperature engine.

As described above, in this embodiment, vapor can be prevented from being generated by increasing the fuel pressure only when needed. In a normal case, the fuel pressure can be set lower than a conventional pressure value. These features can remarkably and effectively reduce consumed electric power of the fuel pump 3 and prolong the life of the fuel pump 3 or the like.

A second embodiment of the present invention will be described.

This embodiment differs from the first embodiment in the structure of the pressure control valve. The explanation of the parts and components identical or equivalent to the first embodiment is omitted or simplified, however, the same numerals are used therefor.

Figure 8A:
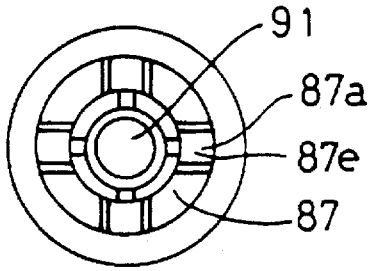
FIGS. 8A–8C show main features of a pressure control valve according to a second embodiment.
Figure 8B:
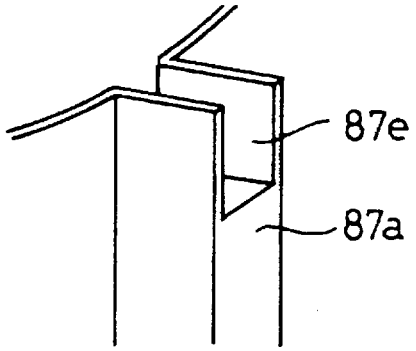
Figure 8C:
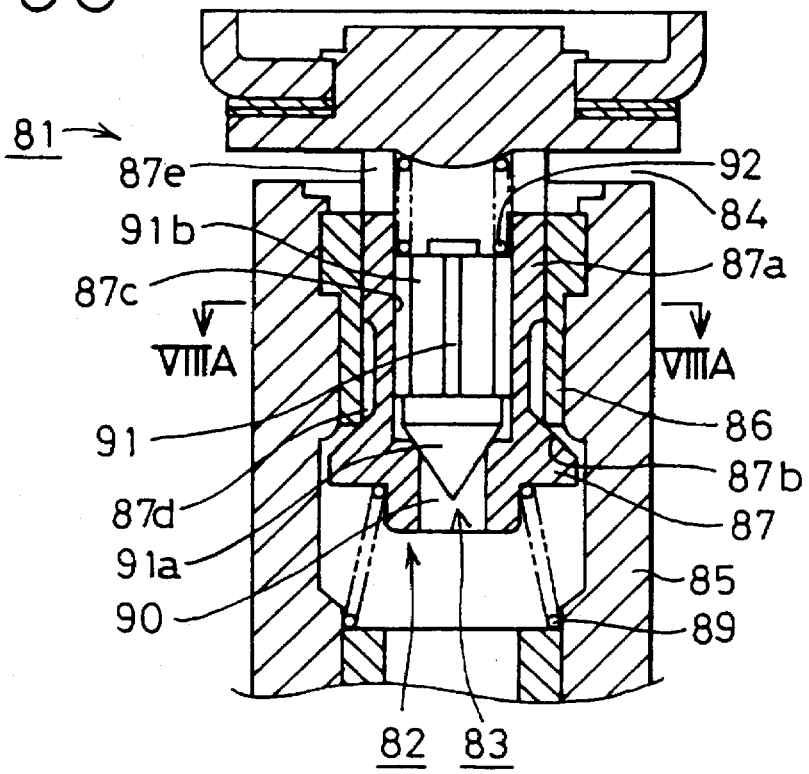

In a pressure control valve 81 of this embodiment shown in FIG. 8C, a bypass valve 83 as a relief valve is disposed at the center of the shaft of a downstream pressure control valve 82.

Furthermore, in the pressure control valve 81, a diaphragm lower chamber 84 formed in a body (not illustrated) accommodates a cylindrical connector 85, and the cylindrical connector 85 accommodates a valve member 87 having a cylindrical valve body 86 and an interior guide 87*a* slidable in the valve body 86. The valve member 87 is biased in the valve closing direction (upwardly in FIG. 8C) by a compression coil spring 89 accommodated at the lower part in the connector 85.

The valve member 87 includes a contacting portion 87*b* which is tapered off toward an interior guide 87*a*. A radial cross section of the interior guide 87*a* is formed in a cross shape having a through hole 87*c* therein (refer to FIG. 8A), and recess portions 87*d* and 87*e* are formed at upper and lower portions thereof.

The downstream pressure control valve 82 is constituted as the above, however, especially in this embodiment, a valve member 91 of the bypass valve 83 is disposed around the shaft of the downstream pressure control valve 82 in a bypassing passage 90 bypassing the downstream pressure control valve 82.

In the bypass valve 83, when the fuel pressure on the upstream side exceeds the differential pressure compared with the fuel pressure at the downstream side, the valve member 91 moves in the valve opening direction (upwardly in FIG. 8C) to open the valve bypass valve 83. The valve member 91 is composed of a tapered edge 91*a* for opening or closing the bypass passage 90 and an interior guide 91*b* extending toward the other edge and being slidable in the bypass passage 90. A radial cross section of the interior guide 91*b* is formed in a cross shape (refer to FIG. 8A), and a compression coil spring 92 for biasing the valve member 91 in the valve closing direction (downward in FIG. 8C) is disposed at the upper edge thereof.

An operation of the pressure control valve 81 will be described.

When the fuel pressure in the fuel rail 15 is lower than a set pressure of the downstream pressure control valve 82, the downstream pressure control valve 82 is opened because the valve member 87 moves downwardly in FIG. 8C by the pressure balance in the same manner as in the first embodiment.

After the fuel pressure gradually increases in this state and reaches the set pressure, the downstream pressure control valve 82 is closed.

When the fuel temperature rises as in restarting the high temperature engine, a discharge pressure is increased by a control as to increase current value of the fuel pump 3, and thereby the fuel pressure on the upstream side gradually increases.

When the fuel pressure on the upstream side increases and the differential pressure between the upstream and downstream sides reaches a valve opening pressure of the bypass valve 83, the valve member 91 of the bypass valve 83 moves upwardly in FIG. 8C resisting the spring force of the compression coil spring 92, and thereby the fuel pressure in the fuel rail 15 increases.

According to the second embodiment, the similar effect as in the first embodiment can be obtained. Further, in this embodiment, since the downstream pressure control valve 82 and the bypass valve 83 are coaxially disposed and move in the same direction, it is more advantageous that a smooth valve operation can be obtained.

A third embodiment of the present invention will be described.

This embodiment differs from the first embodiment in different the condition as to increase a discharge pressure of the fuel pump. The explanation of the parts and components identical or equivalent to the first embodiment is omitted or simplified, however, the same numerals are used therefor.

Figure 9:
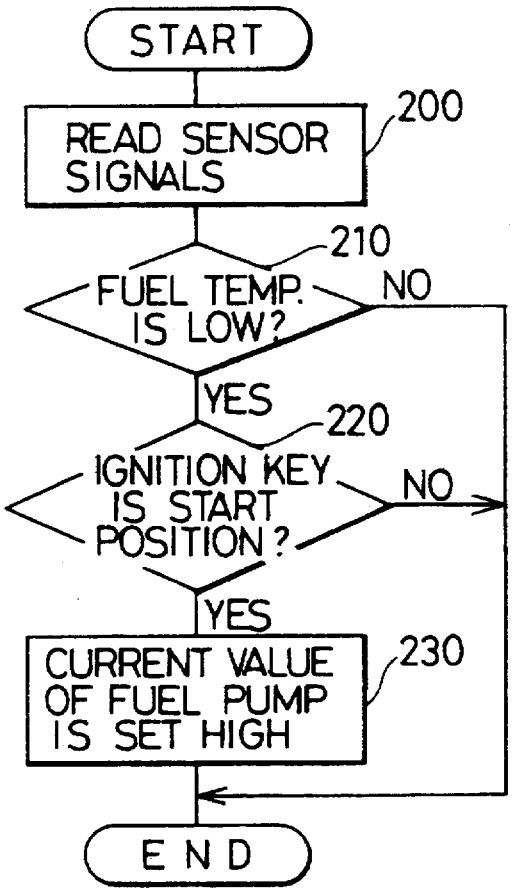
FIG. 9 is a flow chart showing a control process of a third embodiment.

At the step 200 in the flow chart shown in FIG. 9, firstly, signals from the water temperature sensor 27 and the fuel temperature sensor 29 are read in.

At the next step 210, it is determined whether or not fuel temperature is low based on the signals. When the determination is YES, it proceeds to the step 220, however, in case the determination is NO, the process is ended once.

At the step 220, it is determined whether or not the ignition key is at the start position based on the signal from the ignition switch 33. When the determination is YES, it proceeds to the step 230, however, in case the determination is NO, the process is ended once.

At the step 230, since it is determined that the engine starts at a low temperature, a control signal is output to the constant current control circuit 23 to change a current value of the direct current electric motor of the fuel pump 3 to a higher value, and the process is ended once. The higher current value is returned to a normal current value after elapsing a predetermined time.

Thus, in this embodiment, when the engine starts at the low fuel temperature, the fuel pressure in the fuel rail 15 is increased by raising the discharge pressure of the fuel pump 3 so as to open the bypass valve 37 as a relief valve. In this way, the atomization of the fuel is improved, and as a result, a purifying capacity of the exhaust gas can be improved by reducing the discharged HC.

A fourth embodiment of the present invention will be described.

This embodiment differs from the first and the third embodiments in a condition as to raise a discharge pressure of the fuel pump. The explanation of the parts and components identical or equivalent to the first embodiment is omitted or simplified, however, the same numerals are used therefor.

Figure 10:
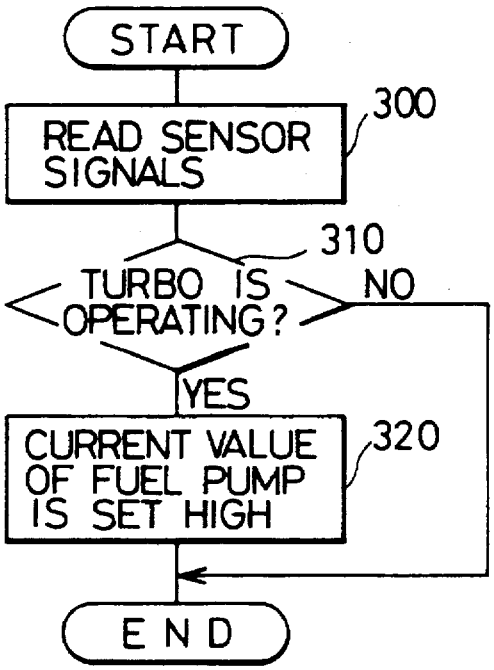
FIG. 10 is a flow chart showing a control process of a fourth embodiment.

At the step 300 in the flow chart shown in FIG. 10, a signal from a turbo-sensor 31 is read in.

At the next step 310, it is determined whether or not the turbo is operating based on the signal. When the determination is YES, it proceeds to the step 320, however, in case the determination is NO, the process is ended once.

At the step 320, since it is determined that the turbo is operating, a control signal is output to the constant current control circuit 23 to change a current value of the direct current electric motor of the fuel pump 3 to a higher value, and the process is ended once. The higher current value is returned to a normal current value after the turbo operation is stopped.

Thus, in the present embodiment, the fuel pressure in the fuel rail 15 is increased by raising a discharge pressure of the fuel pump 3 by opening the bypass valve 37 as a relief valve while the turbo is operating, and thereby a dynamic range of the fuel injector 17 can be changed. Even if a pulse range of the injector is the same, more fuel can be injected, which effectively improves control performance of the engine.

A fifth embodiment of the present invention will be described.

This embodiment differs from the first to fourth embodiments in that an electromagnetic valve which opens or closes by a control signal is used as the bypass valve. The explanation of the parts and components identical or equivalent to the first embodiment is omitted or simplified, however, the same numerals are used therefor.

Figure 11:
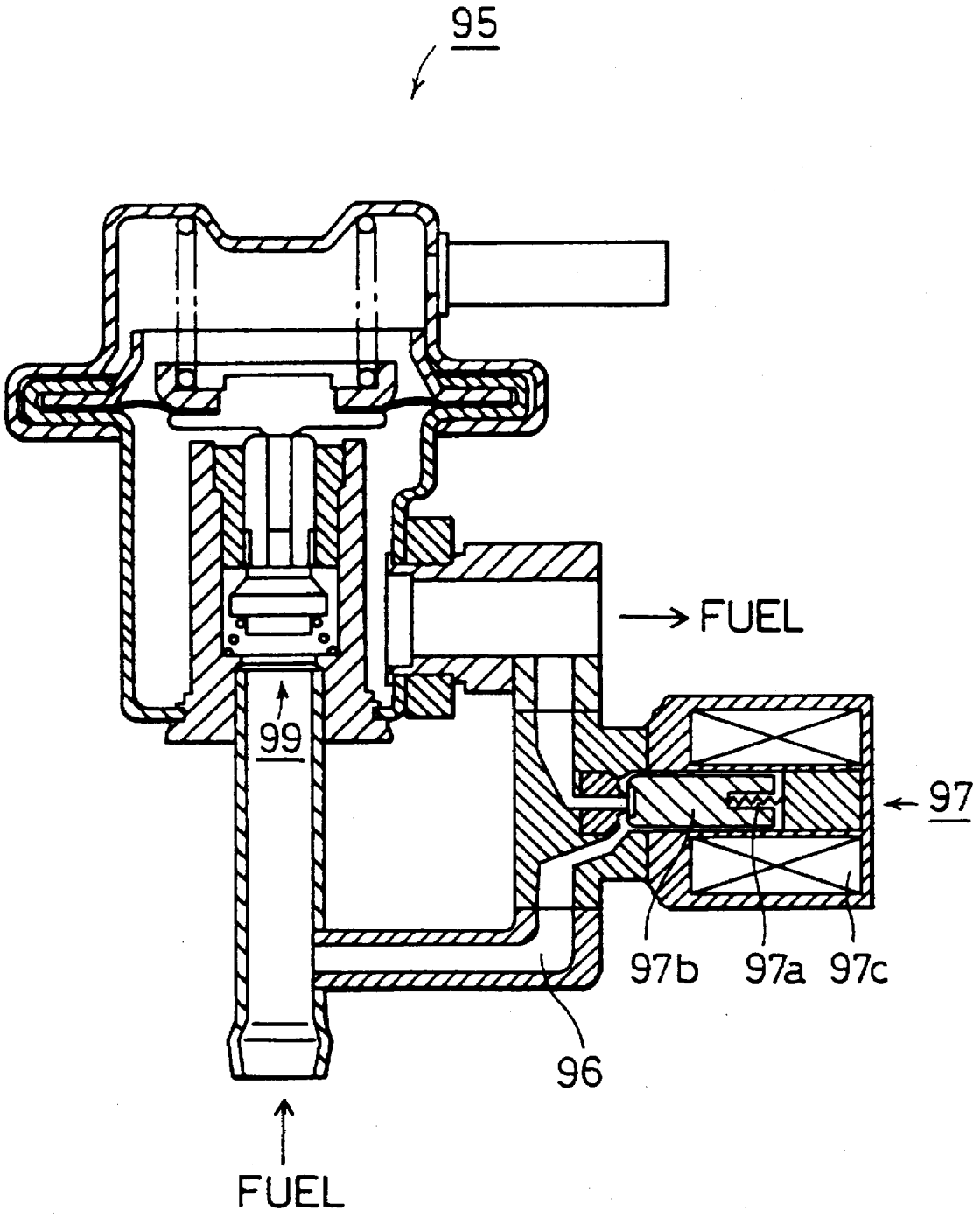
FIG. 11 is a cross sectional view showing a pressure control valve and an electromagnetic valve according to a fifth embodiment.

As shown in FIG. 11, a bypass passage 96 bypassing a downstream pressure control pressure valve 99 in a pressure control valve 95 is formed, and an electromagnetic valve 97 for opening or closing the bypass passage 96 is disposed in a pressure control valve 95, construction of which is substantially same as in the first embodiment (except the structure of the bypass valve in the first embodiment).

The electromagnetic valve 97 normally closes the bypass passage 96 by a compression coil spring 97*a*, however, it opens the bypass passage 96 by moving a valve member 97*b* with electromagnetic force of a solenoid 97*c* when the electricity is supplied. In this embodiment, an upstream side sensor and a downstream side sensor (not shown) for detecting the fuel pressure are provided on the upstream and the downstream sides of the downstream pressure control valve 99, respectively.

A control process of this embodiment will be described.

Figure 12:
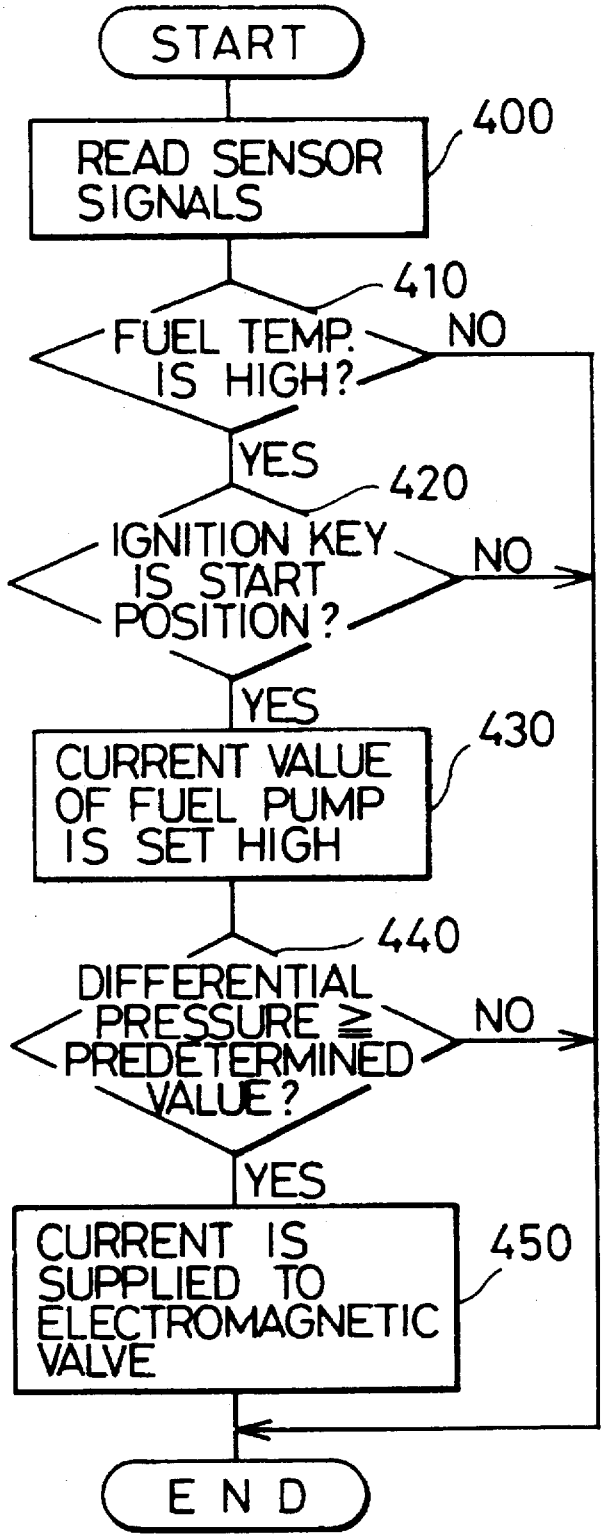
FIG. 12 is a part of a flow chart showing a control process of the fifth embodiment.

At the step 400 in the flow chart shown in FIG. 12, signals related to the fuel pressure at both the upstream and the downstream sides from the upstream side sensor and the downstream side sensor as well as signals related to the fuel temperature from the fuel temperature sensor 29 and the water temperature sensor 27 are read in.

At the next step 410, it is determined whether of not the fuel temperature is high based on the signals. When the determination is YES, it proceeds to the step 420, however, in case the determination is NO, the process is ended once.

At the step 420, it is determined whether or not the ignition key is at the start position based on a signal from the ignition switch 33. When the determination is YES, it proceeds to the step 430, however, in case the determination is NO, the process is ended once.

At the step 430, since it is determined that the engine starts at a high temperature, a control signal is output to the constant current control circuit 23 to change a current value of the direct current electric motor of the fuel pump 3 to a higher value.

At the following step 440, it is determined whether or not the fuel pressure on the upstream side is larger than the fuel pressure at the downstream side by a predetermined value, i.e., whether or not the differential pressure of the fuel pressure at the upstream and the downstream sides exceeds a predetermined value. When the determination is YES, it proceeds to the step 450, however, in case the determination is NO, the process is ended once.

At the step 450, since the differential pressure exceeds the predetermined value, the bypass passage 96 is opened by supplying electricity to the electromagnetic valve 97. Then, the fuel having a higher fuel pressure on the upstream side is delivered to the downstream side to raise the fuel pressure in the fuel rail 15, and the process is ended once.

In this embodiment, in restarting the high temperature engine, a discharge pressure of the fuel pump 3 is increased and the fuel pressure in the fuel rail 15 is also increased by opening the bypass passage 96 with the electromagnetic valve 97, and thereby the similar effect as the first embodiment can be obtained. In addition, in this embodiment, since it is easy to change the setting of opening timing of the electromagnetic valve 97, it advantageous that more accurate control can be performed.

Although the present invention has been fully described in connection with the preferred embodiments thereof with reference to the accompanying drawings, it is to be noted that various changes and modifications will become apparent to these skilled in the art. Such changes and modifications are to be understood as being included within the scope of the present invention as defined by the appended claims.

For example, the aforementioned embodiments show examples where the fuel pump is controlled by a current value, however it can be controlled by voltage value.

What is claimed is:

1. A fuel supply apparatus for an internal combustion engine, said apparatus comprising;

a fuel injector for injecting fuel into said engine;

a fuel rail for supply fuel to said fuel injector;

a fuel pump for pressurizing and discharging fuel to said fuel rail through a fuel supply passage;

a pressure control valve for maintaining fuel pressure in said fuel rail on a downstream side thereof at a predetermined value;

a bypass passage connecting an upstream side of said pressure control valve to said downstream side of said pressure control valve so as to bypass said pressure control valve; and a bypass valve for opening or closing said bypass passage, wherein said bypass valve releases pressurized fuel from said upstream side to fuel rail on said downstream side.

2. A fuel supply apparatus as in claim 1 wherein said bypass valve is a relief valve which is opened when pressure on said upstream side becomes higher than pressure on said downstream side with a predetermined differential pressure.

3. A fuel supply apparatus as in claim 2, wherein a valve opening differential pressure of said bypass valve is set to a value so as not to be opened when said fuel pump discharges fuel with normal pressure.

4. A fuel supply apparatus as in claim 1, wherein said bypass valve is opened when pressure on said upstream side becomes larger than pressure on said downstream side.

5. A fuel supply apparatus as in claim 1 wherein said bypass valve is an electromagnetic valve.

6. A fuel supply apparatus as in claim 1, further comprising:

a direct current electric motor for driving said fuel motor; and a control unit for controlling a current value or a voltage value of said direct current electric motor at a predetermined set value.

7. A fuel supply apparatus as in claim 6, wherein said control unit controls said current value or said voltage value based on an operating condition of said engine.

8. A fuel supply apparatus as in claim 7, wherein said control unit increases said current value or said voltage value when said operating condition of engine satisfies a predetermined condition to increase fuel pressure in said fuel rail.

9. A fuel supply apparatus as in claim 8, wherein said control unit increases said current value or said voltage value when said engine restarts if fuel temperature is higher than a predetermined value.

10. A fuel supply apparatus as in claim 8, wherein said control unit increases said current value or said voltage value when said engine starts if fuel temperature is lower than a predetermined value.

11. A fuel supply apparatus as in claim 8, wherein said control unit increases said current value or said voltage value when combustion of said engine is changed by increasing fuel injection amount.

12. A fuel supply apparatus as in claim 8, wherein said engine is equipped with a turbocharger for supplying high density intake air into said engine, and said fuel injection amount is increased when said turbocharger is operating.

13. A fuel supply apparatus as in claim 1, wherein the other end of said fuel supply passage is connected to said fuel rail only, so that all the fuel from said fuel supply passage is supplied to said fuel rail without returning to said fuel tank.

14. A fuel supply apparatus for an internal combustion engine, said apparatus comprising:

a fuel injector for injecting fuel into said internal combustion engine;

a fuel raft for supplying fuel to said fuel injector;

a fuel pump for pressurizing and discharging fuel to said fuel raft through a fuel supply passage;

a direct current electric motor for driving said fuel pump;

a control unit for controlling a current value or a voltage value of said direct current electric motor at a predetermined set value;

a pressure control valve for maintaining the fuel pressure in said fuel rail on a downstream side thereof at a predetermined value;

a bypass passage connecting an upstream side of said pressure control valve to said fuel rail on the downstream side of said pressure control valve so as to bypass said pressure control valve; and a bypass valve for opening or closing said bypass passage in accordance with an operating condition of said internal combustion engine.

15. A fuel supply apparatus as in claim 14, wherein said control unit increases said current value or said voltage value when said engine restarts if fuel temperature is higher than a predetermined value.

16. A fuel supply apparatus as in claim 14, wherein said control unit increases said current value or said voltage value when said engine starts if fuel temperature is lower than a predetermined value.

17. A fuel supply apparatus as in claim 14, wherein said control unit increases said current value or said voltage value when combustion of said engine is changed by increasing fuel injection amount.

18. A fuel supply apparatus as in claim 14, wherein said engine is equipped with a turbocharger for supplying high density intake air into said engine, and said fuel injection amount is increased when said turbocharger is operating.

19. A fuel supply apparatus as in claim 14, wherein the other end of said fuel supply passage is connected to said fuel rail only, so that all the fuel from said fuel supply passage is supplied to said fuel rail without returning to said fuel tank.

20. A method of controlling a fuel supply system for an internal combustion engine, said method comprising:

injecting fuel into said engine;

supplying fuel to said fuel injector via a fuel rail;

pressurizing and discharging fuel to said fuel rail through a fuel supply passage;

maintaining fuel pressure in said fuel rail on a downstream side of a pressure control valve at a predetermined value; and opening a bypass passage around the pressure control valve to release pressurized fuel from an upstream side to the fuel rail on said downstream side when extra fuel pressure is needed.

21. A method as in claim 20 wherein said bypass valve is opened in response to fuel pressure thereacross exceeding a predetermined differential pressure.

22. A method as in claim 21 wherein said bypass valve is not opened when said fuel pump discharges fuel with normal pressure.

23. A method as in claim 20 wherein said bypass valve is electromagnetically operated.

24. A method as in claim 20 further comprising:

driving said fuel pump with a controlled current or voltage value of direct current at a predetermined set value which is changed based on an operating condition of said engine.

25. A method as in claim 24 wherein said current or voltage value is increased when said engine restarts if fuel temperature is higher than a predetermined value.

26. A method as in claim 24 wherein said current or voltage is increased when said engine starts if fuel temperature is lower than a predetermined value.

27. A method as in claim 24 wherein said current or voltage value increases when combustion of said engine is changed by increasing fuel injection amount.

28. A method as in claim 24 wherein said engine is equipped with a turbocharger for supplying high density intake air into said engine and said fuel injection amount is increased when said turbocharger is operating.

* * * * *